United States Patent [19]

Fee

[11] 4,195,750

[45] Apr. 1, 1980

[54] MOLDED FLANGE FOR DRUMS OR OTHER CONTAINERS

[75] Inventor: Max J. Fee, Hamilton, Ind.

[73] Assignee: Rieke Corporation, Auburn, Ind.

[21] Appl. No.: 12,943

[22] Filed: Feb. 15, 1979

Related U.S. Application Data

[63] Continuation of Ser. No. 837,683, Sep. 29, 1977, abandoned.

[51] Int. Cl.[2] ..... B65D 41/04; B65D 53/00; B65D 39/00

[52] U.S. Cl. ..... 220/288; 220/304; 220/308

[58] Field of Search ..... 220/288, 304, 308; 215/DIG. 1

[56] References Cited

U.S. PATENT DOCUMENTS

| | | | |
|---|---|---|---|
| 1,851,938 | 3/1932 | Reike | 220/288 X |
| 2,220,893 | 11/1940 | Dodson | 220/288 X |
| 3,424,481 | 1/1969 | Fulghum | 220/304 X |
| 3,747,962 | 7/1973 | Bauman | 220/288 X |
| 3,851,794 | 12/1974 | Hehl | 220/308 |

*Primary Examiner*—Steven M. Pollard

*Attorney, Agent, or Firm*—Woodard, Weikart, Emhardt & Naughton

[57] ABSTRACT

A flange for a container opening has an internally threaded aperture to receive a plug, and a plurality of external serrations in a circularly spaced-apart relationship around the periphery of the upper portion of the flange. The plug is externally threaded and, when mated with the flange, closes the aperture. Both the flange and the plug are molded out of plastic material as single integral components. On the lower portion of the flange is an annular lip which is positioned beneath and extends radially beyond the external serrations. A container suitable for the flange has a boss around the container opening in a wall (usually the end wall) of the container. The boss is formed with internal serrations equal in number to the number of external serrations on the flange. This boss can be crimped onto the flange placed in the opening, such that the two groups of serrations permanently interlock with one another thereby securely locking the flange into the container. At the same time the annular lip seals against the inner face of the wall (usually the end wall). The plug is removable from the flange when access to the contents of the container is desired.

16 Claims, No Drawings

MOLDED FLANGE FOR DRUMS OR OTHER CONTAINERS

This is a continuation, of application Ser. No. 837,683, filed Sept. 29, 1977, now abandoned.

BACKGROUND OF THE INVENTION

1. Field of the Invention

This invention relates in general to container fittings and in particular flange-like fittings which are rigidly joined within a container opening.

2. Description of the Prior Art

Containers which are fabricated for the sealed shipment of various solutions or chemicals are often used as storage and dispensing containers after receipt. When such continuing use is intended, these containers may be provided with some type of resealable outlet which enables a portion of the contents to be removed and then close the container in order to retain the balance of the contents. In other circumstances, an external member such as a faucet, nipple, or pump may be screwed into the container outlet when controlled dispensing is desired. In either case, the container must provide suitably sized and compatibly positioned mating threads, or the like, for the engagement of such external members.

Normally the container end thickness is insufficient to allow threads to be formed or machined therein and thus some type of boss or insert, usually referred to as a "flange," must be used to provide additional stock thickness. Presently available are plastic flanges which may be crimped around a raised and out-turned lip which forms an outlet of the container. However, many of these containers are internally coated with a type of chemically-inert material in order to keep the contents within the container uncontaminated, and any forming or drawing operation to the wall of the container which would occur after such a coating had been applied, such as forming a boss or an out-turned lip, would subject this coating to the likelihood of fracture and cracks. This would destroy the integrity of the coating. If a metal flange is used to provide the desired internally threaded fitting, then this flange must still be secured in some manner to the container and must be fitted with a closure element such as a plug to seal the contents of the container during shipment. In order to avoid contamination of the contents, the plug and flange may both be constructed of or coated with a chemically-inert material. A disadvantage of using metal components for this type of container flange design is the increase in time and costs associated with the coating of these components, and susceptibility to destruction of such coating in use, as by installing and removing a plug or faucet.

SUMMARY OF THE INVENTION

One embodiment of the present invention comprises a container, a cylindrically shaped flange member and a plug. The container has a boss with a passageway therethrough opening into the container. The flange member has an internally threaded aperture therethrough and a plurality of external serrations in a circularly spaced-apart relationship around the periphery of the flange member. The plug cooperates with the aperture for sealing the aperture closed. The boss is formed with a plurality of internal serrations surrounding the passageway and these internal serrations are able to be crimped into locking engagement with the external serrations to sealingly secure the flange member into the passageway. The flange seals against the interior of the container at a circle of significantly greater diameter than that of the boss.

One object of the present invention is to provide an improved flange for closure of a container opening.

Related objects and advantages of the present invention will be apparent from the following description.

BRIEF DESCRIPTION OF THE DRAWINGS

FIG. 1 is a perspective view of a container and closure assembly according to a typical embodiment of the present invention.

FIG. 2 is a top view of a flange member comprising a portion of the FIG. 1 assembly.

FIG. 3 is a sectional view of the FIG. 2 flange member taken along line 3—3 in FIG. 2.

FIG. 4 is a top view of a boss comprising a portion of the FIG. 1 container.

FIG. 5 is a side view of the FIG. 4 boss taken along line 5—5 in FIG. 4.

Figure 6:
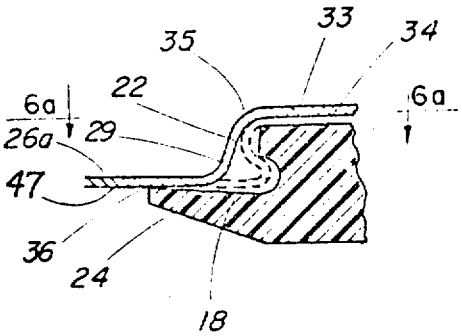
FIG. 6 is an enlarged section view of the flange member in the container prior to performing a crimping operation.

FIG. **6*a* is a partial sectional view of an interlocking arrangement for the flange member and container prior to crimping together taken along line 6*a*—6*a* in FIG. 6**.

Figure 7:
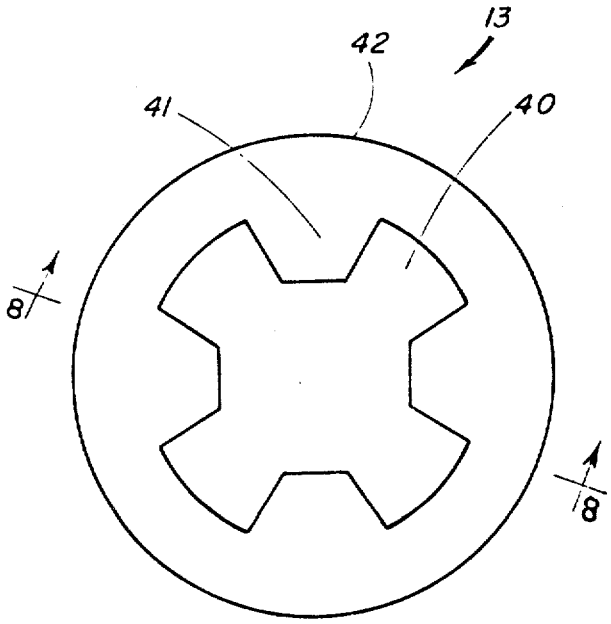

FIG. 7 is a top view of a plug comprising a portion of the FIG. 1 assembly.

Figure 8:
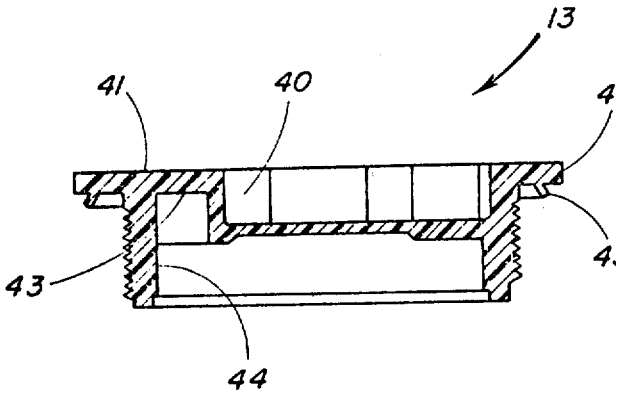

FIG. 8 is a sectional view of the FIG. 7 plug taken along line 8—8 in FIG. 7.

Figure 9:
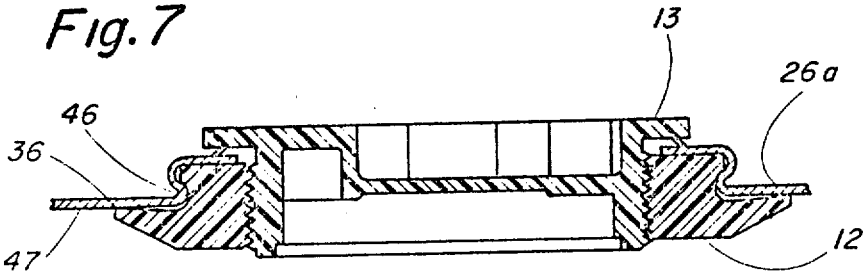

FIG. 9 is a sectional view of a flange member and plug installed in the container taken along line 9—9 in FIG. 1.

FIG. **9*a* is a sectional view of a cap associated with the FIG. 1** assembly.

FIG. **9*b* is a sectional view of a lid associated with the FIG. 1** assembly.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, flange assembly 10 is oriented in container 11 in an installed and sealed condition such that the contents within container 11 are enclosed. As described herein, flange assembly 10 is a two-component device including a flange member 12 which is secured to container 11 and a plug 13 which communicates with flange member 12 by means of mating threads.

Flange member 12 is a generally cylindrically shaped component having disposed centrally therein an internally threaded aperture 16. As shown in FIGS. 2 and 3, a radially extending annular lip 17 is provided at the base of the flange. The top surface 18 of lip 17 is inclined upwardly at a slight angle while the bottom surface 19 is inclined upwardly at a greater angle than the top surface 18, thereby giving a generally tapered appearance to lip 17.

A boss portion 22 of the flange includes a series of "serrations" 23 which are part circular in appearance. The longitudinal axis of curvature of each serration is substantially parallel to the longitudinal axis of aperture 16. The material left between the part circular spaced serrations forms a series of outwardly projecting tab-shaped ribs 23*a*. At the base of the serrations 23 and adjoining the lip top surface 18 is an annular, semicircular recess 24 which provides a corner relief radius between serrations 23 and lip 17 to facilitate the fabrication of flange member 12 whether the member is machined or molded. Recess 24 also provides means for securing flange member 12 into container 11 as will be described hereinafter. Annular lip 17 extends radially a considerable distance beyond the serrations 23, thereby providing a container end wall contacting and sealing surface for flange member 12 which will be described in greater detail later.

Flange member 12 should be made of a material, usually an engineering plastic, suited to the end use of the container, and possessing the resilience and memory and softness needed to provide a seal as will be described later herein. Polypropylene or modified polypropylene may be suitable for some applications of the flange.

The flange member of the disclosed embodiment is approximately 0.50 inches thick, 3.90 inches in outside diameter across lip 17 and 3.10 inches in outside diameter across boss portion 22. It has eighteen serrations. Aperture 16 is approximately 2.30 inches in inside diameter. Of course, such dimensions and numbers of serrations are only examples and their mention here in no way limits the subject invention to a particular container or container outlet size or serration number.

The container 11 illustrated for purposes of example, is of a drum-like, generally cylindrical shape constructed of a suitable rigid material for the particular volumetric and weight capacity. It includes a body 26 and circular end plates 26*a* and 26*b* (usually metal and sometimes referred to as drumheads) whose edge periphery is encircled by body 26. The end plates are rigidly attached to body 26 by some suitable seaming procedure such that the entire assembly is made into a rigid sealed container. To facilitate the joining of the end plates to the body, the end plates may have an upturned rim which is engaged by a downturned rim on the body.

End plate 26*a* has a generally cylindrical boss 25 having a passageway 27 therethrough which opens into the container. Boss 25 is formed in a one-step operation which cold-flows the metal into the desired shape and size as shown by FIGS. 4 and 5. The container end plate is pierced and drawn to the desired height and shape by dies. The dies used for this shaping operation are such that a series of internal serrations 28, uniformly spaced around passageway 27, are formed in the drawn upright wall 29 of boss 25. The serrations have a circular portion as viewed from above (FIG. 4) and the longitudinal axis of the circular portion of each of the various serrations 28 is substantially parallel to the longitudinal axis of passageway 27. The material of wall 29 between each pair of serrations 28 is in the shape of inwardly projecting edges 30.

Although boss 25 is preferably located in the top end plate 26*a* for convenient filling and emptying of the contents of container 11, it is possible to position boss 25 in other locations. Of course, as will be noted from the drawings, flange member 12 is positioned internally to container 11 and thus, when reading the following discussion of boss 25 and the securing of flange member 12 to the boss, it should be kept in mind that end plate 26*a* of container 11 is actually fitted with flange member 12 prior to completing the fabrication of container 11. Otherwise, there would not be means available to position flange member 12 within the finished container.

Figure 6A:
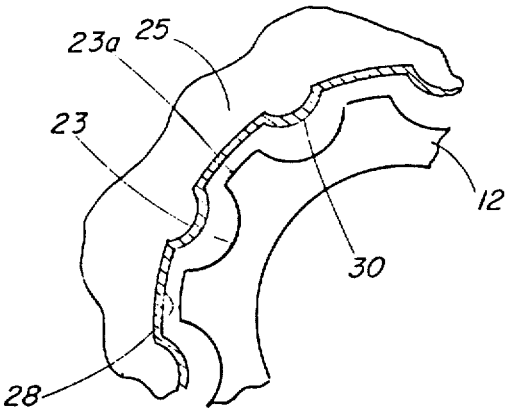

The forces necessary for an effective drawing operation of boss 25 depend upon the size of the boss and the material 11 and the wall thickness of end plate 26*a*. A deeper draw, that is a greater height for boss 25, requires greater drawing forces. In the embodiment shown as an example, the height of boss 25 as indicated by arrowed line 31 is approximately 0.25 inches, the diameter of passageway 27 is approximately 2.5 inches and the wall thickness of the container is approximately 0.040 inches. Once boss 25 has been formed in end plate 26*a*, flange member 12 is inserted such that the various surfaces and contours of boss 25 and flange 12 are oriented relative to each other as shown in FIGS. 6 and 6*a*. In this position, the longitudinal axis of flange member 12 is virtually coincident with the longitudinal axis of passageway 27. In addition, flange member 12 is radially turned relative to boss 25 so that the tab-shaped ribs 23*a* are adjacent serrations 28 and serrations 23 are adjacent edges 30. With this interlocking relationship established, flange member 12 is ready to be permanently and rigidly secured into boss 25 by means of a crimping operation uniformly performed to the circumference of boss 25. This operation may be performed by means of tooling which fits under and around flange member 12. This tooling supports the bottom of the flange member which in turn presses against the top of boss 25 when being inserted which in turn prevents raising or buckling. The tooling also includes a plurality of jaws which, when tightened, draw the upright wall 29 in toward recess 24 and beneath boss portion 22. The details of such tooling and its method of use can be ascertained by reference to U.S. Pat. No. 3,747,962 issued July 24, 1973 to Bauman for the apparatus, and by reference to U.S. Pat. No. 3,791,021 issued Feb. 12, 1974 to Bauman for the method. During this crimping operation, the serrations 28 in the wall 29 of boss 25 are pressed inwardly toward tab-shaped ribs 23*a*. When the ends of ribs 23*a* come in contact with the base of serrations 28, wall 29 is actually formed around ribs 23*a* as edges 30 are pressed into engagement with the base of serrations 23. Thus, the combination of serrations 28 and edges 30 are interlocked into the combination of serrations 23 and ribs 23*a*.

While this crimping and securing of flange member 12 into boss 25 is being performed, wall 29 is contoured to wrap around and underneath boss portion 22 of the flange and into semicircular recess 24. This draws the outer corner 35 of boss 25 of end plate 26*a* around boss portion 22 of the flange and brings the top surface 33 of boss 25 into contact with outer face 34 of flange member 12. As wall 29 conforms to semicircular recess 24, the portions of container end plate 26*a* which surround boss 25 remain virtually horizontal and due to the slight upward incline of top surface 18 of the flange lip, as wall 29 moves inwardly during the crimping operation, the underside 47 of container end plate 26*a* pushes against upper circular edge 36 of the lip tending to force annular lip 17 downwardly into a more horizontal position. Due to resilience of the material of the flange, the flattening or bending downward of the lip establishes a preload force exerted by container end plate 26*a* on lip 17 which will maintain tight sealing engagement between the container flange member 12 and the underside 47 of the end plate.

The interlocking serrations, ribs and edges provide an extremely strong and reliable means by which relative motion between flange member 12 and boss 25 is prevented. For example, when external components such as faucets, nipples, pumps or pipes are screwed into internally threaded aperture 16 the flange member 12 will not turn or otherwise loosen within boss 25.

The benefit derived from the extent of overhang of flange member 12 beneath boss 25 is that any cracking or splitting of the chemically-inert lining which has been applied to the inner surface 47 of the drumhead (end plate 26*a*) and which cracking may occur during formation of the boss, will be covered by lip 17 of flange member 12, and located radially inward from the circumferentially sealing portion of the lip at, and adjacent to, circular edge 36. Therefore, although the forming and drawing operation which creates boss 25 in end plate 26*a* may in fact crack the chemically-inert lining, these cracks will not provide a source of contamination for the contents within container 11 due to the fact that chemically-inert flange member 12 completely overlaps any cracks which are formed and thereby seals out the contents from possible contamination. In addition, this sealed condition allows the dispensing of contents from the container through pipes, faucets, and the like without leakage around the flange area.

Plug 13 is a generally cylindrical, externally threaded sealed closure member which is compatibly sized and arranged to threadedly mate with threaded aperture 16 of flange member 12. Plug 13 has a fluted recess 40 in top surface 41 which is surrounded by lip 42. The plug is constructed of a suitable plastic material, which is molded into the one-piece plug shown. The underside of recess 40 is structurally reinforced with various reliefs, such as cavity 43, of which there are four equally spaced around inner wall 44. Lip 42 is relatively thin, approximately 0.12 inches, and it may be difficult to completely tighten plug 13 into container 11 in order to adequately seal the container closed. Similarly, it may be difficult to obtain a secure enough grip on plug 13 once it has been tightened to remove it from the container. To resolve this problem without increasing the thickness of lip 42 and thus the height at which plug 13 would extend beyond the end of the container, a specially contoured tool, or similar means, shaped to fit into recess 40 may be used for installing and removing plug 13.

Plug 13 represents only one possible container closure means and it is to be understood that various plug and cap designs could be used equally well with flange member 12. However, one feature of plug 13 which provides an advantage over more conventional plugs is the presence of annular protrusion 45. This protrusion is slightly flared in an outwardly pointing direction and is compressible as plug 13 is tightened into flange member 12 (see FIG. 9). The compression of protrusion 45 causes the protrusion to flatten out as it flexes outwardly along top surface 33 of boss 25 toward outer corner 35. Such arrangement may provide yet another seal for the contents within container 11. This is a type of secondary seal and may be desirable in the event leakage occurs between flange member 12 and boss 25; possibly the result of damage to one or both components.

Figure 9A:
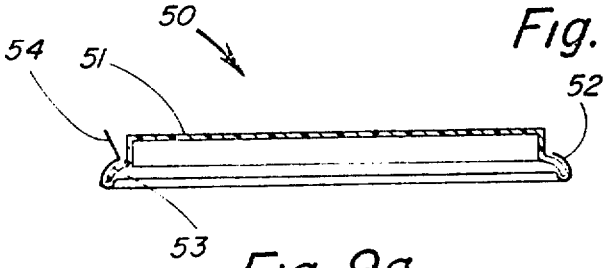
Figure 9B:
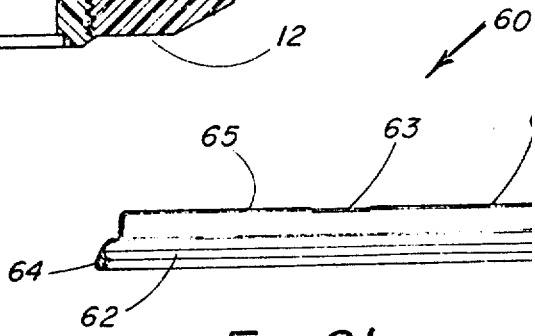

A further feature of the subject container device is that with boss 25 crimped around flange member 12, a recess 46 is provided beneath reduced diameter portion 22 and adjacent semicircular recess 24. This recess 46 provides a reduced diameter cavity into which a closure device 50 or 60, such as shown in FIGS. 9*a* and 9*b*, for example, may be crimped.

Cap 50 is a two-part closure device comprising a plastic sealing member 51 and a metal securing ring 52. Although only a sectional view has been shown, it is to be understood that member 51 and ring 52 are generally circular in shape. Ring 52 is constructed of an easily formed material, such as aluminum, for example, such that when crimped into and around recess 46, a tight seal will be created between cap 50 and boss 25 by means of flexible lower lip portion 53. A pull-tab 54 is provided as part of ring 52 such that by pulling downwardly on pull-tab 54, a segment of material will be torn out of ring 52, disrupting its otherwise continuous nature and thus allowing the ring to be removed. Lid 60 comprises a metal cap portion 61, an inner gasket seal 62 and a pull-tab 63. Although only a sectional view has been shown, it is to be understood that cap portion 61 and gasket seal 62 are generally circular in shape. The gasket seal is bonded to the inner surface of outer lip 64 and when the outer lip is crimped into and around recess 46, gasket seal 62 forms a tight seal against boss 25. Pull-tab 63 begins with a gripping portion located at one edge of top surface 64 and extends to the opposite edge and down the side. With lid 60 crimped onto boss 25, as pull-tab 63 is gripped and pulled across top surface 65, such as with a pair of pliers, a segment of metal is torn from cap portion 61 completely down over the side causing the cap portion to separate and become removable from boss 25.

Transporting and storage containers with flanges fabricated according to the present invention may be low in cost and sturdy. The containers may be made of metal, fiber, or other materials. They may be lined with a coating suitable to protect the container or contents, or both; and the container end can be of metal and can be formed with a boss without concern that the drawing of the metal will destroy the integrity of the lining. Flange materials can be used which are best suited to in-use conditions, materials to be contained, and manufacturing procedures. Materials can be resistant to extremely high temperatures, 300° F., for example, thereby providing manufacturing versatility as to the sequence of operations.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A closure device insertable into a container opening for enclosing the contents of said container which comprises:

a cylindrically shaped flange member having a plurality of serrations in a spaced apart relationship disposed around the periphery of said flange member adjacent an upper end, an internally threaded aperture therethrough and an integrai annular lip portion beneath said serrations and adjacent a lower end of said flange member, said annular lip portion having a top surface which is inclined upwardly as it extends outwardly;

a plug cooperating with and received by said internally threaded aperture for sealing said aperture closed; and said annular lip portion extending radially beyond said serrations and arranged relative to said serrations for tight, preloaded sealing engagement by said top surface with an interior surface of the container.

2. The closure device of claim 1 in which said cylindrically shaped flange member is of a single-piece, molded plastic construction of polypropylene.

3. The closure device of claim 2 in which said plug further includes a depending, flexible annular protrusion arranged so as to contact an exterior surface of said container when said plug is received by said internally threaded aperture.

4. The closure device of claim 1 in which said flange member is of a single-piece, molded resilient engineering plastic.

5. In combination:

a metal container having a boss in a first end with a passageway therethrough opening into said container;

a cylindrically shaped flange member having an internally threaded aperture therethrough and an integral annular lip portion adjacent one end of said flange member and having a top surface which is inclined upwardly as it extends outwardly, said flange member further including a plurality of external serrations in a spaced apart relationship around the periphery of said flange member adjacent the other end; and said boss being formed with a plurality of internal serrations surrounding said passageway, said internal serrations being crimpable into locking engagement with said external serrations to secure said flange member into said passageway and to draw said flange member upwardly such that the top surface of said annular lip portion is pressed into tight, preloaded sealing contact against the interior of said container first end locations radially beyond the boss.

6. The combination of claim 5 in which said lip is disposed in a pushed-down orientation by the wall of said container once said flange is crimped in place in said passageway.

7. The combination of claim 6 which further includes a plug cooperating with said internally threaded aperture for sealing said aperture closed.

8. The combination of claim 7 in which said plug further includes a depending, flexible annular protrusion arranged so as to contact an exterior surface of said container when said plug is received by said internally threaded aperture.

9. The combination of claim 8 in which said plug is externally threaded and said flexible protrusion is placed in sealing engagement with said boss once said plug is fully threaded into said flange member.

10. The combination of claim 9 in which said plug is of a single-piece, molded engineering plastic.

11. The combination of claim 10 in which said container is internally coated with a material which is substantially inert to the intended contents of said container.

12. A container seal insertable into a container for adapting said container to receive an external fitting which comprises:

a cylindrically shaped flange member having an internally threaded aperture therethrough, a plurality of serrations in a spaced-apart relationship around the periphery of said flange member and an annular resilient lip extending radially beyond said serrations for preloaded sealing engagement with an interior surface of the container, said lip having a top surface which is inclined upwardly as it extends radially outward, said top surface contacting said interior surface and said serrations providing means for securing said flange member within said container.

13. The container seal of claim 12 in which said cylindrically shaped flange member is of a single-piece, molded plastic construction of polypropylene.

14. The combination of claim 6 in which said flange member seals against the interior of said container at a circle of significantly greater diameter than that of said boss.

15. The combination of claim 5 which further includes a two-part crimpable closure cap cooperating with said crimped boss for sealing said aperture closed, said crimpable closure cap including a plastic sealing member and a metal securing ring tearably removable from said plastic sealing member for releasing said crimpable closure cap from said sealing closed cooperation with said crimped boss.

16. The closure device of claim 1 wherein said cylindrically shaped flange member further includes a part-circular annular recess opening outwardly and disposed adjacent the underside of said serrations and adjacent said annular lip portion, the lower edge of said part-circular annular recess contacting the innermost portion of said top surface.

* * * * *

UNITED STATES PATENT AND TRADEMARK OFFICE

CERTIFICATE OF CORRECTION

PATENT NO. : 4,195,750

DATED : April 1, 1980

INVENTOR(S) : Max J. Fee

It is certified that error appears in the above—identified patent and that said Letters Patent is hereby corrected as shown below:

The two sheets of drawings comprising of Figs. 1 thru 9b should be included as part of Letters Patent 4,195,750.

Signed and Sealed this

*Tenth* Day of *June 1980*

[SEAL]

*Attest:*

SIDNEY A. DIAMOND

*Attesting Officer*

*Commissioner of Patents and Trademarks*

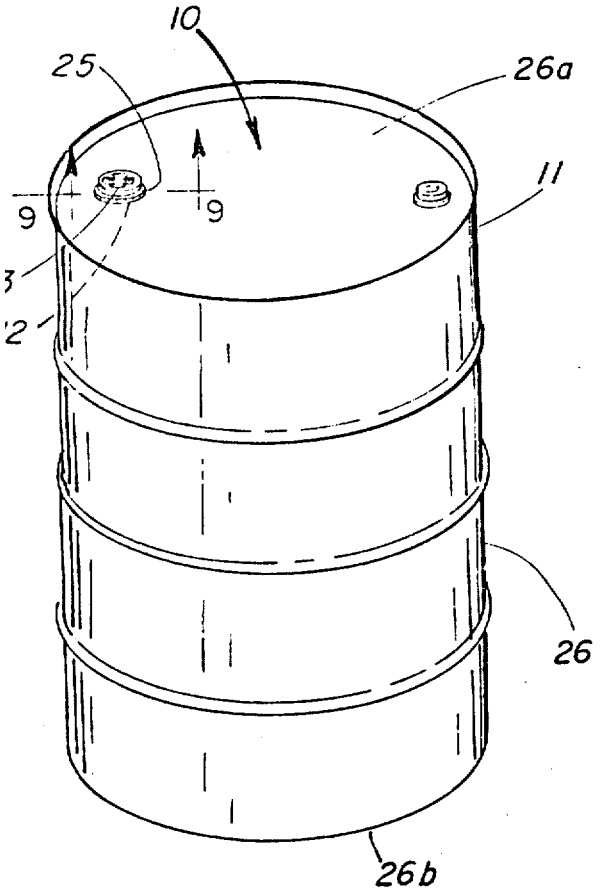
Fig. 1
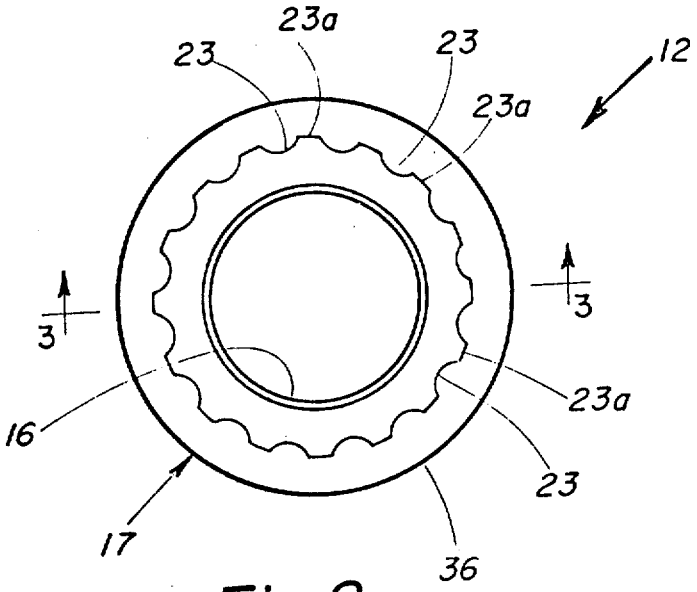
Fig. 2
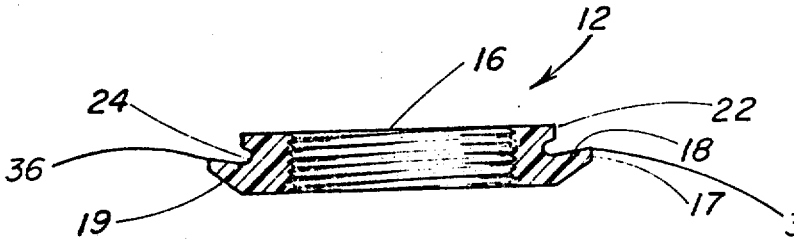
Fig. 3
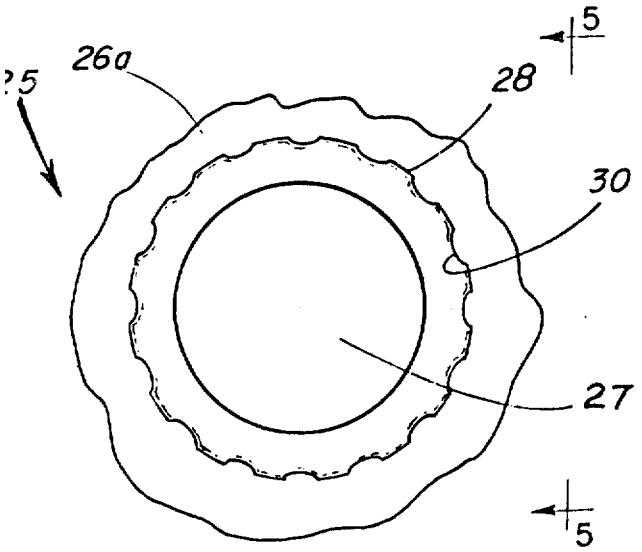
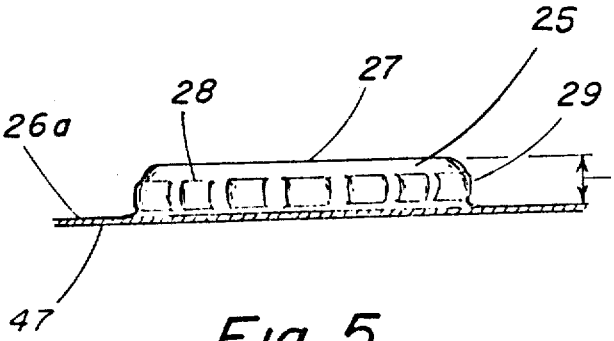
Fig. 5